US005944123A

United States Patent [19]

Johnson

[11] Patent Number: 5,944,123

[45] Date of Patent: Aug. 31, 1999

[54] HYDRAULIC JETTING SYSTEM

[75] Inventor: Ashley Bernard Johnson, Milton, United Kingdom

[73] Assignee: Schlumberger Technology Corporation, Sugar Land, Tex.

[21] Appl. No.: 08/700,720

[22] Filed: Aug. 15, 1996

[30] Foreign Application Priority Data

Aug. 24, 1995 [GB] United Kingdom ..... 9517378

[51] Int. Cl.[6] ..... E21B 7/08; E21B 7/18

[52] U.S. Cl. ..... 175/73; 175/61; 175/67

[58] Field of Search ..... 175/73, 61, 67

[56] References Cited

U.S. PATENT DOCUMENTS

| | | | |
|---|---|---|---|
| 3,884,051 | 5/1975 | Bottoms | 175/321 |
| 3,924,698 | 12/1975 | Juvkam-Wold . | |
| 4,211,292 | 7/1980 | Evans | 175/61 |
| 4,291,773 | 9/1981 | Evans | 175/61 |
| 4,440,242 | 4/1984 | Schmidt et al. . | |
| 4,461,359 | 7/1984 | Jones, Jr. et al. . | |
| 4,534,427 | 8/1985 | Wang et al. | 175/67 |
| 4,637,479 | 1/1987 | Leising . | |
| 4,674,579 | 6/1987 | Geller et al. . | |
| 4,714,118 | 12/1987 | Baker et al. . | |
| 4,768,709 | 9/1988 | Yie | 175/67 |
| 4,919,204 | 4/1990 | Baker et al. . | |
| 4,991,667 | 2/1991 | Wilkes, Jr. et al. | 175/61 |
| 5,314,030 | 5/1994 | Peterson et al. . | |
| 5,421,420 | 6/1995 | Malone et al. | 175/61 |
| 5,449,046 | 9/1995 | Kinnan | 175/73 X |
| 5,485,889 | 1/1996 | Gray | 175/61 |
| 5,513,713 | 5/1996 | Groves | 175/73 |
| 5,553,678 | 9/1996 | Barr et al. | 175/73 |
| 5,553,679 | 9/1996 | Thorp | 175/73 |

FOREIGN PATENT DOCUMENTS

| | | |
|---|---|---|
| 2 246 151 | 1/1992 | United Kingdom . |
| 2 284 837 | 6/1995 | United Kingdom . |

*Primary Examiner*—Hoang C. Dang
*Attorney, Agent, or Firm*—Douglas Y'Barbo

[57] ABSTRACT

Apparatus for drilling a well comprising, in one embodiment, a borehole assembly having a motor rotated drill head with ports for emitting a fluid, coiled tubing operatively associated with the drill head to supply fluid and support the drill head, the borehole assembly adapted to drill a channel off axis by varying the speed of the motor drive during a cycle or by varying fluid pressure to the drill head during a cycle.

20 Claims, 2 Drawing Sheets

32
34
28
30
38
26
10
24
12
18
22
20
36
38
16
14

HYDRAULIC JETTING SYSTEM

FIELD OF THE INVENTION

This invention relates to a hydraulic jetting system for drilling boreholes into a geological substrate.

BACKGROUND TO THE INVENTION

Systems for drilling into geological structures so as to extract oil and gas via a borehole are well known. Particular systems use fluid jets which may be loaded with abrasive particles to erode the rock substrate and drill the required borehole. In such systems typically a rotating drill bit with outlet nozzles is supplied with fluid via a drill string from the surface. Pipe is used to connect the drill bit to the surface and to enable rotation. The pressure of the fluid is such that as the jet of fluid issues from the nozzles, the force of the impact is expended in the substrate so causing removal of the rock substrate to create a borehole. Typically drilling occurs through a number of different substrates or strata until the appropriate stratum containing the substance of interest is reached. The substance may be oil or gas.

The nozzles placed in the drill bit are typically spaced about the bottom area of the drill bit at varying radii in order to give the desired cutting profile into the rock substrate. Such a system is described in U.S. Pat. No. 3,924,698 where a number of nozzles are positioned to drill grooves into the rock substrate below the drill bit. The nozzles are arranged at varying angles depending on their position from the central axis of the drill bit so as to ensure that the grooves drilled are of equal depth. These systems are suitable for direct drilling down through a substrate where a high pressure is available at the surface and can be substantially maintained down to the drill bit and utilised in jetting fluid through the nozzles.

In the system described in U.S. Pat. No. 3,924,698, during operation the nozzles in the rotating drill bit expel a stream of abrasive laden fluid to act against the rock bed. As the drill bit moves further down the borehole, stand off elements on the bottom of the bit are forced against the partially eroded rock structure and readily break down the walls between the individual grooves.

In existing boreholes that have been used to tap strata bearing a particular substance, the extraction rate of the substance from the borehole decreases with time. To increase the extraction rate the channel from the stratum that is tapped by the borehole must be opened up. Typically this involves casing window milling and using a drill string to drill a lateral well. However when the target stratum is thin, such systems are not suitable.

Attempts have been made to use abrasive free cutting systems with more flexible coiled tube(CT) systems to drill lateral drain holes into the stratum to improve the extraction rate of the substance contained in the stratum. However these known systems suffer severe performance problems and the pressure drop at the nozzle of 10,000 psi is such that it is unsuitable for use with CT systems in downhole conditions.

A further coiled tubing system is described in U.S. Pat. No. 5,413,184 where a ball cutter is coupled to the tubing and lowered into the borehole. The ball cutter cuts through the borehole casing which limits the exposure of the borehole to the substance bearing stratum and is moved outwardly into the stratum for a preselected distance. After the preselected distance is reached, the ball cutter and tubing are wound back to the surface and the ball cutter replaced with a nozzle blaster. The nozzle blaster is lowered into the borehole until it extends through the channel previously created by the ball cutter. When the end of the pre-cut channel is reached, fluid is pumped through the nozzle blaster to cut through the stratum. This system requires extraction of the tubing between the successive cutting stages and the direction of travel of the nozzle blaster is determined by the pre-cut channel.

THE INVENTION

According to the invention in a drilling method involving the rotation of a drilling member which includes a fluid delivery means for supplying drilling fluid to the drillin, member to issue therefrom via one or more orifice therein, it has been found that off axis advance of the drilling member can be achieved by modulating the rotational speed of the drilling member as it rotates.

In accordance with the invention therefore drilling apparatus for boreholes, comprises a drilling member with a port for emitting fluid, a fluid transfer member, drive means for rotating the drilling member, and modulating means for varying the rotational speed of the drilling member, such that in use the variations in rotational speed cause the drilling member to drill a channel off axis from the axis of rotation.

The drilling member may be used to create a new borehole or to further excavate an existing borehole. Such boreholes may either be those used by the oil industry or water suppliers, or holes required by utility companies, for example for power cables.

It is to be understood that fluid includes reference to fluid and material combinations, for example where abrasive particles, polymers or other additives are added to a liquid.

The drilling apparatus may have a joint portion provided in the fluid transfer member so as to substantially isolate the weight of the drilling member from the weight of the fluid transfer member.

According to another aspect of the invention a drilling member is provided, the drilling member comprising a drill head with a port for emitting fluid, a fluid transport member, drive means for rotating the drill head, and speed modulating means for varying the rotational speed of the drill head, such that in use the rotational speed of the drill head may be modulated so as to cause the drilling member to advance in a direction which diverges from the axis of rotation.

The speed is preterably modulated during each rotation of the drilling member. In a typical process the speed of rotation will be varied between 35 and 45 rpm during each rotation or cycle. However other rotational ranges are also suitable for use.

By way of explanation of the surprising effect noted, the speed of rotation of the drilling member affects the traverse speed of the jet across the target and hence the jet/target contact time. The erosion of the substrate thus varies as the speed of rotation varies. Modulation of the rotational speed of the drilling member during one cycle means that the erosion effect of the fluid will be varied during the cycle, so that one region of the hole is preferentially eroded in relation to other regions of the hole.

Increase in the rotational speed reduces the axial and radial penetration of the fluid jet into the substrate, and reduces the channel diameter created by the jet. Reduction in the rotational speed has the opposite effect, increasing the channel diameter.

Thus as the speed is modulated through one cycle the amount of material eroded varies during the cycle, so that the hole diameter becomes larger on one side relative to the other side. This results in a hole which is off axis from the central axis of the drilling member rotation and as the drilling member continues drilling into the substrate, the direction of the borehole will change. A small change during each rotation of the drilling, member in the rotational speed, can result in a significant change in the direction of the axis of the hole.

Preferably the fluid transfer member is flexible and typically may be provided by a coiled tubing system. The resulting change in direction of the hole drilled by the drilling member will then depend on the hardness of the rock substrate and the flexibility of the fluid transfer member.

The drive means may be an electric motor. The modulating means used to alter the speed of rotation of the electric motor may be a clutch device.

In a preferred embodiment, the drive may be obtained from a stepper motor which is driven by electrical pulses and the instantaneous frequency of the pulses is modulated within the rotational cycle to achieve the speed modulation.

Alternatively the speed modulation may be achieved by altering the transfer rate of the fluid via the fluid transfer member, for example by modulating the pressure behind the supply of fluid to the drilling member.

In a preferred embodiment the drilling member is provided with sensing means so that the drilling member position can be detected and adjusted so as to create a preferred channel direction from an existing borehole. Typically both direction and inclination are sensed to determine the drilling member position. These channels may be used to provide drainage of the borehole, and in particular increased production of the substance from the stratum.

The detection of the travel of the drilling member in relation to the existing borehole by use of the sensing, means allows the frequency of modulation to be altered in response to the travel of the drilling member through rock substrates of varying erosion characteristics. This ensures that the variations in rock hardness and hence drilling ability can be accommodated to give substantially the same configuration of lateral channel despite varying substrate conditions.

The sensing means may communicate with the surface by a wireline or other signal transfer medium, such as telemetry.

The port for emitting fluid may be provided by one or more nozzles. The nozzles are typically placed at the front portion of the drilling member, the drill head, and may be angled within the drill head so as to ensure the required erosion profile of the drill member is achieved. A preferred angle that may be used is 15° to the axis of the drill member. However the nozzles may be placed at other angles, with individual nozzles at varying angles if required. The positioning of the nozzles over the drill head is preferably asymmetric and the nozzles may advantageously be placed in a spiral configuration, although other asymmetric arrangements are possible. Such an asymmetric arrangement is of particular advantage when adjusting the travel of the drilling member by modulation. Alternatively the asymmetric arrangement may be achieved by use of adjustable nozzles, where the nozzle direction is altered in response to the travel of the drilling member.

In such systems the drilling member does not contact the surface to achieve removal of the substrate, but substrate removal occurs from the fluid impact with the substrate. As a result the torque required to rotate the drilling member is small.

The drilling member may further include contact members which extend beyond the drill head so that in use with a fluid supply the contact members act to position the drill head from a substrate face to be drilled, such that the distance between the emitted fluid and the substrate face remains substantially constant as drilling occurs. This is of particular advantage for the rate of progress of the drilling member when in use.

A fluid with substantially no solid material admixed may be employed for emission from the port. Alternatively the fluid may contain solid material to increase its erosion characteristics. This is of particular advantage where hard rock substrates are encountered, when fluid alone may not be adequate to achieve erosion of the substrate.

The invention will now be described, by way of example, with reference to the accompanying drawings in which.

GENERAL OVERVIEW OF COMPLETE SYSTEM

Coiled tubing (CT) systems have a similar flow area available to fluid supplied from the surface via the CT system to a drilling member or drill bit. The maximum size of the high strength ductile steel coiled tubing is typically 2 3/8inches ID, with sizes of a smaller internal diameter being common. Coiled tubing carries fluid or fluid/material mixtures and may contain a number of separate cables for telemetry or electricity. The cables may be "hepta" cable (7 conductors) or "mono" cable (1 conductor). The maximum surface pressure that can be accommodated with a CT system is 5000 psi. This limits the pressure available at the nozzle outlet at downhole positions, pressure beings lost from the surface to the outlet due to turbulent flow of the fluid within the CT system. The pressure transfer from the surface to the drill bit is thus not as efficient as for drill pipe systems and the pressures that are available for use within the drill pipe systems cannot be accommodated within CT systems. The overall pressure drop between the surface and the drill bit is crucial to the erosion performance of the individual jets carried within the drill bit. A CT system typically uses the parameters shown in Table 1 below.

Figure 1:
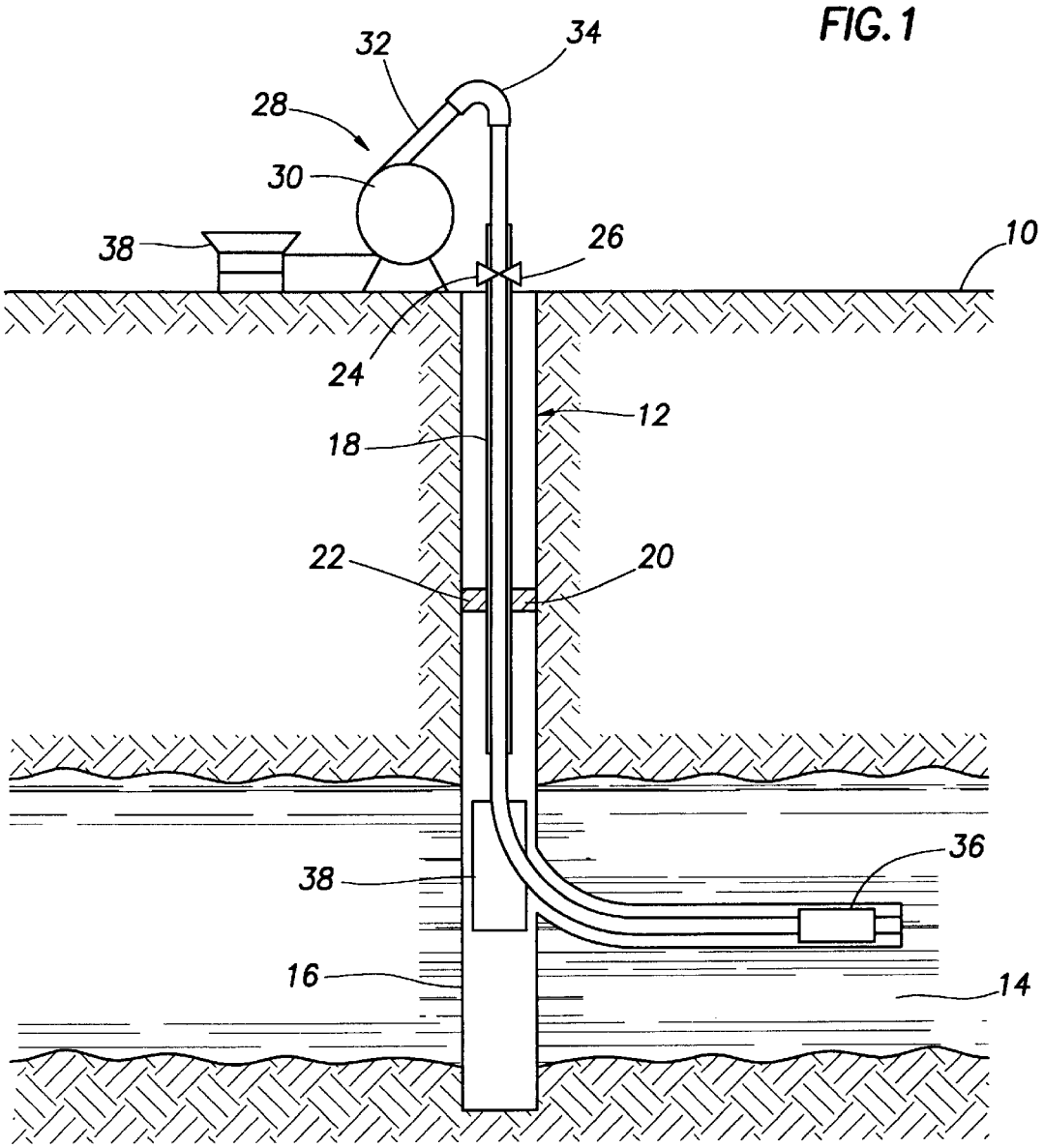
FIG. 1 shows a schematic diagram of a drilling, system in accordance with the invention.

A schematic diagram of a drilling system in accordance with the invention is shown in FIG. 1. This diagram shows the basic elements of the drilling system. Typically a system in accordance with the invention is used with an existing borehole where the production of oil or other substance from a bearing stratum has declined and increase in production is required.

TABLE 1

| CT drilling system parameters | |
|---|---|
| Surface Pressure | 3500 psi |
| Fluid | Water |
| Liner (ID) | 4.5" |
| CT (OD) | 2.38" |
| CT Wall Thk | 0.156" |
| Depth | 8,000 ft |
| Reel | 10,000 ft |

FIG. 1 shows use of a system in accordance with the invention in relation to an existing borehole 12. The upper surface from which drilling takes place is denoted by 10. The existing borehole 12 is shown in enlarged cross-section. The borehole 12 is drilled to reach a particular stratum 14 which typically bears oil, although water or gas may be contained within the stratum 14. To enable production of oil, or other substance, from the stratum 14, an outer casing 16 typically with an outer diameter of 7 inches is cemented in place in the drilled hole 12. The casing 16 ensures that zonal isolation is achieved and that any substances contained in the strata above 14 are not drawn up through the centre of the borehole 12 during the extraction process. Production tubing 18 is held in position inside the casing 16 by supports 20, 22. The production tubing 18 typically has an outer diameter of between 2 ⅜" and 5" Valves 24, 26 are provided at the surface to open and close the opening to the production tubing 18 as required.

It is possible to use the system according to the invention to drill the borehole, however the rate of progress of the drilling process by this technique is slow when compared to conventional techniques and so typically other methods are likely to be used to create the initial borehole. More usually the system according to the invention is used to drill channels into the stratum 14 to increase production of the borehole.

A drilling system in accordance with the invention as shown in FIG. 1, uses a coiled tubing system 28. The coiled tubing system 28 includes a coiled tubing unit 30 to supply coiled tubing down into the borehole 12. The coiled tubing unit 30 is typically a large drum with coiled tubing 32 would onto it. The coiled tubing 32 is fed from the coiled tubing unit 30 to pass around a goose neck 34 and down into the production tubing 18. The size of the coiled tubing 32 is chosen so that there is clearance between the inner diameter of the production tubing 18 and the outer diameter of the coiled tubing 32. Typically the goose neck 34 is vertically supported above the production tubing so that prior to insertion of the coiled tubing, a drilling member, such as a bottom hole assembly (BHA) 36 containing a drill bit, may be attached to the lower end of the coiled tubing so that as the coiled tubing 32 is fed from the coiled tubing 30, the BHA 36 assists with the travel of the coiled tubing down the production tubing 18. The dimensions of the BHA 36 are such as to ensure the BHA readily passes down through the production tubing 1S.

The coiled tubing 32 is typically made from a high strength ductile steel so as to have sufficient strength to bear its own weight and that of downhole tools, for example the BHA 36, in the borehole.

The coiled tubing 32 is supplied with fluid from a pump and mixer 37. The fluid may be water, or more typically the fluid is water mixed with additives, such as abrasives and polymers, to form a slurry. The slurry can be formed by mixing the fluid and additives in a tank or hopper before the fluid reaches the pump, or alternatively mixed after the pump in a high pressure mixer. The mixer allows slurry flows to be metered and blended with high pressure liquid flows. The fluid produced by the pump and mixer 37 is supplied to the coiled tubing 32 at pressure for supply to the BHA 36 via the coiled tubing 32.

In a drilling system according to the invention, as the BHA 36 and coil tubing 32 are lowered down through the production tubing 18, a deployment system 38 acts to divert the BHA 36 through a tight turning angle so as to enter into the stratum 14 through the production casing 16. Conventional systems using drill pipe can only manage a turning angle of 20° per 100 ft., the present system can achieve turning over a much smaller radius. This is due to the flexibility of the coiled tubing and the size of the BHA, which must necessarily be a lesser diameter than the production tubing 18.

DETAILED DESCRIPTION OF CONSTRUCTION AND OPERATION OF PREFERRED BHA

Figure 2:
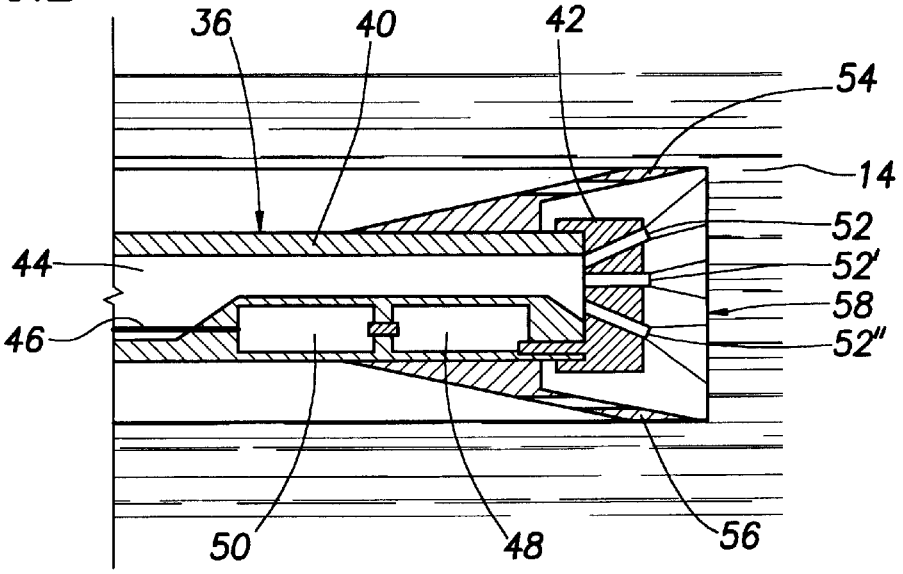
FIG. 2 shows a bottom hole assembly bearing a drilling member for use in the system, as shown in FIG. 1.

The construction and operation of BHA 36 can be seen with reference to FIG. 2. As shown in FIG. 1, according to the invention the BHA 36 acts to drill a channel into the stratum 14. BHA 36) is connected to the coiled tubing 32 and is supplied with fluid or slurry, electricity, and communication systems via the coiled tubing. The BHA 36 comprises a drill bit 40 with a rotating drill head 42, a fluid supply means 44, a motor actuating means 46, a motor 48 for rotating the drill head 42 and a sensing means 50. The rotating drill head 42 has a number of separate nozzles or ports 52, 52 , 52" positioned over it, as shown in section. The nozzles are attached to the fluid supply means 44 and are supplied with fluid or slurry from the surface by means of the coiled tubing 32 to which the BHA is attached. In operation the fluid or slurry issues from the nozzles at pressure to produce jets which erode the surrounding rock substrate. The sensing means 50 and motor activating means 46 are similarly supplied with the necessary signal transfer media by the coiled tubing 32, and this is typically achieved by one or more wire lines. In addition the drill bit 40 may be provided with control arms 54, 56 to alter and adapt the stand-off, i.e. the distance from the nozzle output to the stratum impact surface, or drill face, 58.

The nozzles 52, 52 , 52" are located at varying diameters on the head 42 to ensure complete coverage of the drill face 58 when drilling. The nozzles are typically placed over the head 42 to produce an asymmetric distribution. Such a configuration may be a spiral arrangement of the nozzles over the head 42. Typically the central jet 52 is positioned to cut ahead of the drill with the remaining jets angled at 15° to the axis so as to ensure increased coverage of the drill face 58 by the job when the head is rotated. Other angles may be used and each nozzle can be at a different angle to the axis. The use of larger angles for the jets requires more turning of the fluid in the head, leading to erosion of the head and lost cutting power for the drill.

An example of the placement of six nozzles on the drill bit is shown in Table 2, where $d_p$ is the cut depth.

TABLE 2

Rotating head, nozzle distribution and nozzle performance, with axial and radial penetration for each jet.

| Nozzle | Dia (mm) | Radius $R_n$ | $d_p$ | Penetration (mm) | Penetration (mm) |
|---|---|---|---|---|---|
| 1 | 2 | 0 | — | — | — |
| 2 | 2.5 | 9 (in) | 12.0 | 11.6 | 3.1 |
| 3 | 2.5 | 9 (out) | 9.7 | 9.4 | 2.6 |
| 4 | 3.25 | 17 | 9.6 | 9.3 | 2.5 |
| 5 | 4 | 26 | 9.1 | 8.8 | 2.4 |
| 6 | 5 | 37 | 9.2 | 8.9 | 2.4 |

The stand-off is controlled by the arms 54, 56 which contact the surrounding rock substrate and prevent the head 42 moving forward until the rock is cut. There is no contact between the head 42 and the rock formation so that a small, low torque motor may be used to drive the head 42. The small torque is required to overcome seal friction between the drill bit 40 and the drill head 42. The motor 48 is typically both powered and controlled by a motor activating means 46 inside the coiled tubing string 32. The BHA 36 preferably also incorporates a sensing means or position detector, 50 to detect parameters such as inclination and direction of the drill bit 40. These detectors may be provided by accelerometers and gyroscopes. Typically with a BHA as used in the current system, the direction and inclination sensors are accelerometers and magnetometers as the small size of the BHA that is required to fit down the production tubing 18 makes use of gyroscopes difficult.

To allow the drill bit to cut effectively, the stand-off should remain constant and this is achieved by use of the control arms 54, 56. The rate of progress of the BHA 36 into the stratum 14 depends on the control of the stand-off. Improved control of the stand-off position achieves a greater rate of progress.

To reduce the effects of buckling of the coiled tubing as the BHA 36 drills into the stratum 14, an unbalanced slip joint, or bumper sub 39, may be placed in the coiled tubing string. This will generate a constant thrust which keeps the control arms 54, 56 in contact with the tool face, optimizing the stand-off and driving efficiency. This will however limit the length of the drain holes.

Use of the System in Non-vertical Drilling

Figure 3:
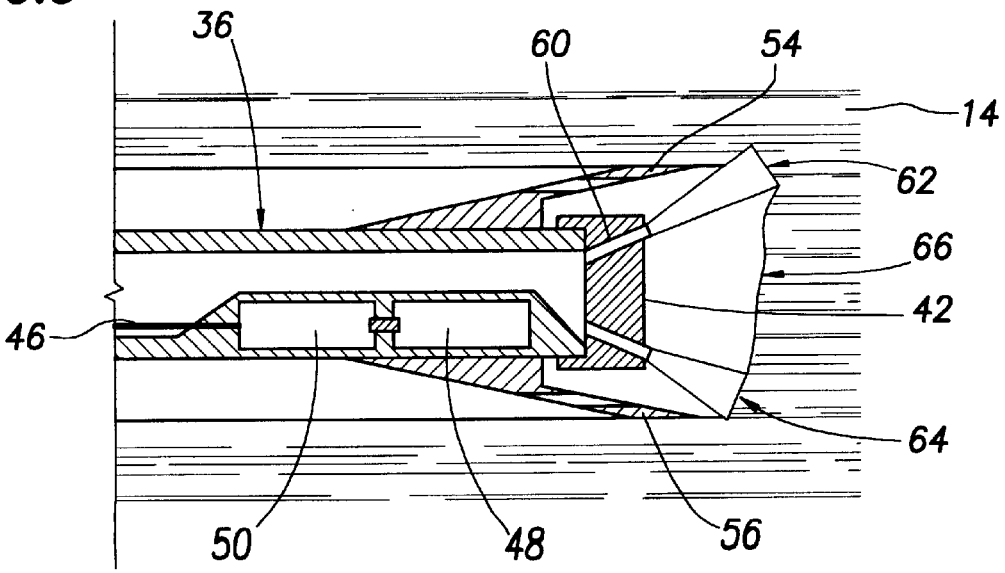
FIG. 3 shows erosion of a stratum by the drilling member in operation.

FIG. 3 shows a section through the stratum 14 which is being eroded by the BHA 36 and in which the rotational speed of the drill head 42 is starting to be modulated in accordance with the invention. The same reference numerals are used for corresponding elements previously discussed. The motor 48 controls the speed of rotation of the rotating head 42. The motor activating means 46 communicates with the surface and is used to alter the rotational speed provided by the motor. The rotational speed provided by the motor 48 is modulated over each cycle of rotation of the drill head 42. The asymmetric noble arrangement over the head 42 ensures that by modulating the rotary speed, differential cutting of the stratum 14 occurs. Variation of the rotational speed of the drill head 42 changes the traverse speed of each jet and alters the cutting performance.

An increase in rotational speed reduces the axial and radial penetration of the fluid jet into the rock substrate 14, which reduces the stand off and in turn the width of channel created. The diameter of a drilled hole is thus reduced. Slowing the rotational speed has the opposite effect increasing the drilled hole diameter. Thus modulation of the rotational speed of the drill head 42 over each rotation, results in differential erosion of the substrate 14. For the system shown in FIG. 3, rotation of the drill bit is at 40 rpm, with modulation over one cycle between 35 and 45 rpm. Other rotational speeds may be used and modulated in a similar manner.

A significant change in hole shape can be achieved for a small change in rotary speed over one rotational cycle. The resulting radius of curvature of the channel due to the modulation will be determined by the resistance to travel of both the BHA 36 and the coiled tubing 32.

The penetration of the jets is dependent on the nozzle parameters, the diameter of the drill bit, the pressure drop at the nozzle, the flow rate of the fluid and the position and angle of the nozzles in relation to the maximum diameter of the drill head. The surface pressure constraints on deliverable power are also relevant to the penetration that can be achieved.

The principle of the erosion of the substrate 14 by the modulated rotation of the drill head 42 and the resulting differential cutting is shown in FIG. 3. This shows a simplified one nozzle case, although several nozzles are present. When the jet from the nozzle 60 cuts the preferred side of the hole, rotation of the head is slowed so as to cut a deeper and wider groove 62 into the stratum 14. On the other side, the rotation of the head 42 is increased, and a more shallow and narrow groove 64 is cut. This results in an offset drill face 66 and a deviated hole. As successive modulated cycles occur, the channel will curve in the preferred direction. By use of the position sensing means 50, the direction and inclination of the BHA 36 can be detected at the surface and the motor modulation varied depending on the desired path of travel, ie. with no modulation being required when a straight channel is required, and modulation when curvature is required. With the present modulation system, the minimum radius of curvature that can be achieved is dependent on the rigid nature of the BHA 36 and the flexibility of the tubing 32. Typically a radius of curvature of less than 10 feet can be achieved. The curvature is obviously limited by the length and width of the BHA, with shorter or narrower BHA's allowing a tighter turn to be achieved. The coiled tubing 32 has fatigue life which is reduced on bending round a tight curvature and therefore a further preferred feature of the invention is to replace the section of coil tubing that joins with the BHA 36 with more flexible tubing.

The use of a coiled tubing system, together with a rotating head with modulated speed as described allows the drilling of lateral drain holes in existing wells so as to improve production of a substance from a stratum without the need to remove existing downhole production tubing to gain access for the drilling machinery.

Typically the invention is applicable to the oil industry, however the invention could also be used either to create or further excavate utility holes, such as those for power cables etc.

I claim:

1. A jet drilling apparatus for drilling wells in a geological substrate comprising a drill bit having a rotatable drill head with one or more ports for emitting a fluid;

at least one contact member which extends from the drill bit and adapted to position the drill head in a borehole in such manner that the contact distance between a port or ports in the drill head for emitting fluid and a substrate face remains constant as drilling occurs;

means for rotating the drill head;

modulating means for varying the rotational speed of the drill head in such manner that the variation in rotational speed of said head causes said drill head to drill a channel off axis from the axis of rotation of the head;

a coiled tubing, adapted to support its own weight and the weight of said bit, operatively associated with said drill head to supply fluid from a source to said drill head and said ports.

2. The apparatus of claim 1 in which more than one port is provided and the ports are positioned asymmetrically over the front portion of the drill head.

3. The apparatus of claim 1 in which a slip joint is provided in the coiled tubing.

4. The apparatus of claim 1 in which a bumper sub is provided in the coiled tubing.

5. The apparatus of claim 1 in which the means for rotating the drill head is an electric motor.

6. The apparatus of claim 1 in which the modulating means for varying the rotational speed of the drill head is a clutch.

7. The apparatus of claim 1 in which the means for rotating the drill head is a stepper motor which is driven by electrical impulses and the instantaneous frequency of the pulses is modulated within a rotational cycle to achieve the speed modulation.

8. The apparatus of claim 1 in which the means for varying the rotational speed of the drill head comprises means for altering the transfer rate of the fluid through the coiled tubing.

9. The apparatus of claim 1 which comprises means for sensing the position of the drill bit.

10. The apparatus of claim 9 in which the means for sensing the position of the drill bit comprise a direction sensor and an inclination sensor.

11. Apparatus for drilling a well in a geological substrate comprising a borehole assembly comprising a drill bit having a rotatable drill head with one or more ports for emitting a fluid;

at least one contact member which extends from the drill bit and adapted to position the drill head in a borehole in such manner that the contact distance between a port or ports in the drill head for emitting fluid and a substrate face remains constant as drilling occurs;

means for rotating the drill head;

means for varying the rotational speed of said drill head during at least one rotational cycle of said drill head;

a coiled tubing, adapted to support its own weight and the weight of said borehole assembly, operatively associated with said borehole assembly to supply fluid from a source to said drill head and said ports.

12. The apparatus of claim 11 in which more than one port is provided and the ports are positioned asymmetrically over the front portion of the drill head.

13. The apparatus of claim 11 in which a slip joint is provided in the coiled tubing.

14. The apparatus of claim 11 in which a bumper sub is provided in the coiled tubing.

15. The apparatus of claim 11 in which the means for rotating the drill head is an electric motor.

16. The apparatus of claim 11 in which the means for varying the rotational speed of the drill head is a clutch.

17. The apparatus of claim 11 in which the means for rotating the drill head is a stepper motor which is driven by electrical impulses and the instantaneous frequency of the pulses is modulated within a rotational cycle to achieve the speed modulation.

18. The apparatus of claim 17 in which the means for varying the rotational speed of the drill head comprises means for altering the transfer rate of the fluid through the coiled tubing.

19. The apparatus of claim 11 which comprises means for sensing the position of the drill bit.

20. The apparatus of claim 19 in which the means for sensing the position of the drill bit comprise a direction sensor and an inclination sensor.

* * * * *